United States Patent [19]

Alderman et al.

[11] 4,153,163

[45] May 8, 1979

[54] ENVELOPE AND FORM ASSEMBLY

[76] Inventors: Norman H. Alderman, 10832 N. 38th St., Phoenix, Ariz. 85028; Willis M. Morris, 7104 N. Via de Paesia, Scottsdale, Ariz. 85258

[21] Appl. No.: 901,722

[22] Filed: May 1, 1978

Related U.S. Application Data

[63] Continuation of Ser. No. 749,772, Dec. 13, 1976, abandoned.

[51] Int. Cl.[2] ..... B65D 27/00; B65D 27/34

[52] U.S. Cl. ..... 206/610; 229/74; 282/25

[58] Field of Search ..... 229/74; 282/22 R, 25, 282/11.5 R, 11.5 A; 206/620, 610

[56] References Cited

U.S. PATENT DOCUMENTS

| | | | |
|---|---|---|---|
| 2,987,327 | 6/1961 | Carmichael | 282/25 |
| 3,525,470 | 8/1970 | Carrigan | 229/74 |
| 3,854,654 | 12/1974 | Van Malderghem | 282/25 |

*Primary Examiner*—Stephen P. Garbe
*Attorney, Agent, or Firm*—LaValle D. Ptak

[57] ABSTRACT

A combination envelope and form assembly for use as an integral shipping envelope has an envelope formed with three closed sides and one open side. The back of the envelope has a self-sticking adhesive to permit attachment of the envelope to a package, and the cover of the envelope is made of transparent material. A data entry cover sheet overlies the envelope cover and is detachably connected to it at the closed end by a line of perforations. A tear strip is provided connected to carbon transfer sheets and insert sheets within the envelope to permit removal of the transfer sheets and at least some of the insert sheets after the data entry has been made. Subsequently, the remaining insert sheets may be removed from the envelope by detaching them from perforations in these sheets located adjacent the sealed end of the envelope.

5 Claims, 13 Drawing Figures

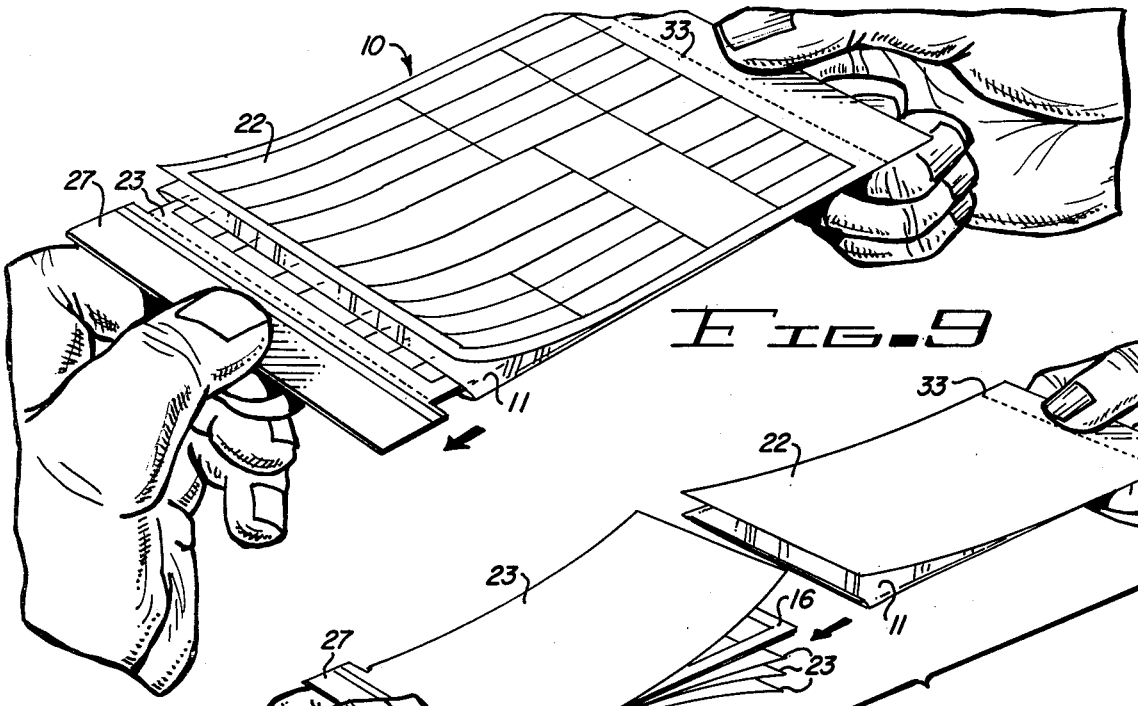
FIG. 9
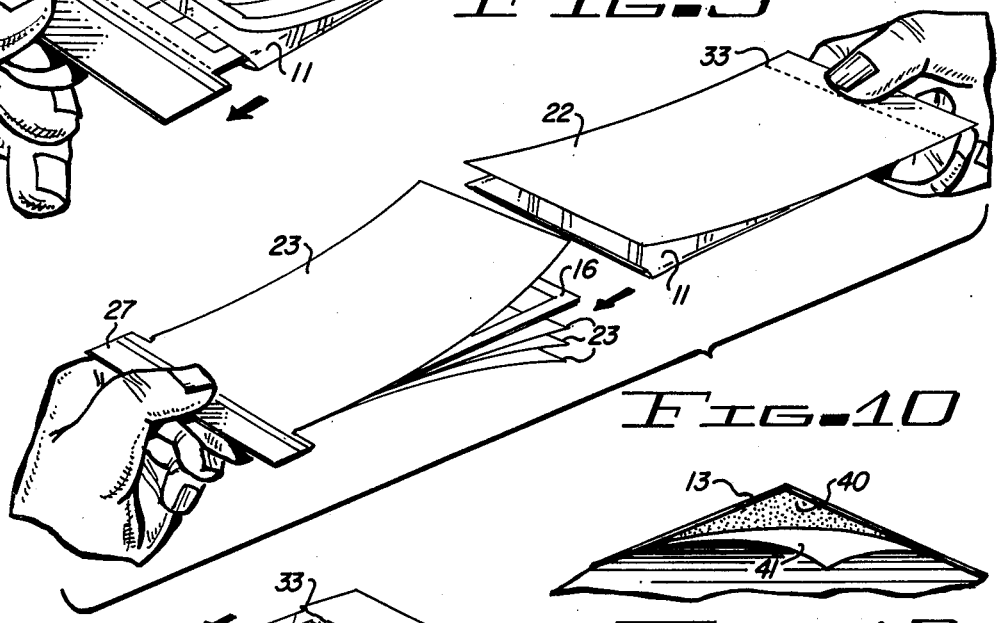
FIG. 10
FIG. 12
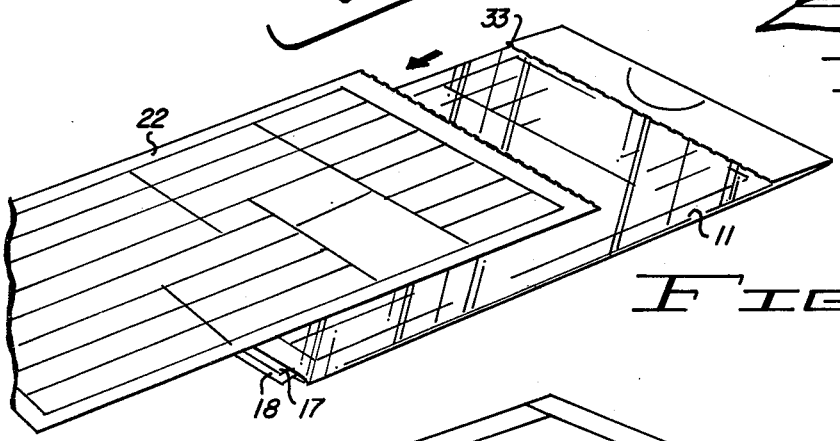
FIG. 11
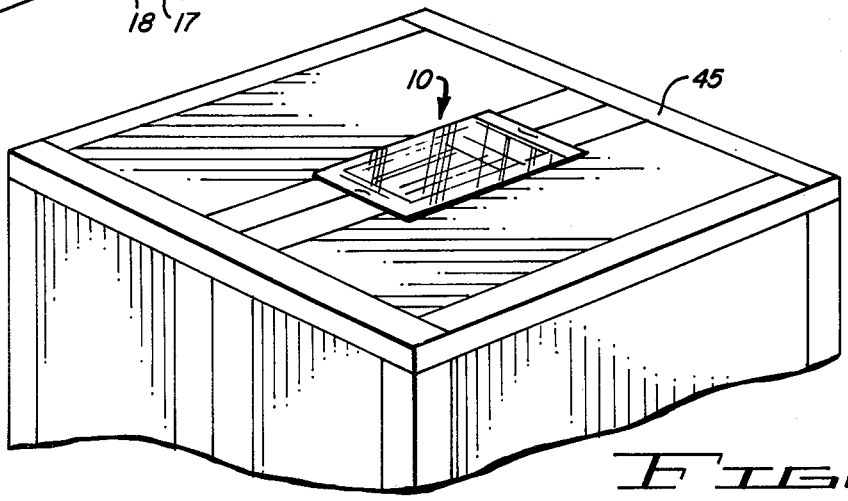
FIG. 13

ENVELOPE AND FORM ASSEMBLY

This is a continuation of application Ser. No. 749,772, filed Dec. 13, 1976, now abandoned.

BACKGROUND OF THE INVENTION

A number of applications exist which require the filling out of a form and providing multiple copies for different uses. In addition, many applications such as bus bills, air bills, express bills, shipping order/packing list forms, and the like, require the filling out of a form at an originating point and further require traveling documents to be attached to a package or to accompany a package to its ultimate destination. Often it is necessary to have multiple copies of the forms which may be readily removed in total at the originating or receiving location or which may be removed in sequence at either of these locations or at intermediate points between the originating point and the final destination of the package which the form accompanies.

Particularly for shipping forms, it is necessary to have a form which may be filled out by the shipper at the time particular goods are to be sent to a remote destination. A substantial amount of information generally must be entered either by hand or typed on the form at the time of shipment since much of this information, such as the addressee, the value of goods, identity of goods, route, etc. is variable and cannot be predetermined. Such forms usually include a receipt to be given to the shipper at the time the goods are turned over to the carrier. In addition, the originating carrier generally requires a copy, and it also is necessary to have a label or traveling documents which bear the necessary information to identify the addressee and the carrier or carriers which are to handle the goods between the shipper and the final addressee. To facilitate the entry of the necessary information on such forms, they generally are created in the form of interconnected multi-copy sheets, including sheets of transfer material such as carbon paper or sensitized paper which may be used to produce multiple copies upon the entry of the data on the top or original copy of the form set. After entry of the data, it is desirable to remove the carbon material to prevent subsequent smudging and obliteration of information on the copies or insert sheets of the form set.

When forms of this type are used as shipper's forms, it has been the practice in the past to fill out the form, remove the receipt copy and the originating carrier's copy from the form set and to place the remaining copy or copies in an envelope which then is attached to the goods to be shipped pursuant to the form. All of this requires a substantial amount of handling at the shipping point, resulting in increased labor costs and the expenditure of a substantial amount of time in preparing a package or the like for shipment.

Multiple layer forms which include built-in sealed mailing envelopes are known. Such forms, however, generally use carbon-coated paper on the inside of the envelope to mark the internal sheets. In addition, the envelopes are opaque and require a carbon backing on at least one outside sheet to enter the necessary information on the outside of the envelope which it is entered onto the original outside receipt of the form set. The user of the set, however, does not know if the papers inside the envelope are imprinted with the required information. In addition, since the carbon paper is not removed from the inside of the envelope, it is possible to obliterate the information on the inside papers during handling of the envelope.

Other envelope/form assemblies are known which permit the removal of the carbon transfer sheets prior to final sealing and mailing of the envelope. Such structures, however, do not permit removal of a portion of the contents prior to its final destination. Also, there again is no assurance that the inside sheets are imprinted properly.

It is desirable to provide a multiple copy shipping form/envelope combination which permits the user to readily ascertain that the desired information has been transferred to the forms inside an envelope upon entry on to an overlying master record sheet and further which permits the removal of the carbon transfer sheets without disturbing the insert sheets prior to shipping. This then would prevent accidental smudging or obliteration of information on the insert sheets. Finally it is desirable to provide a shipping form/envelope combination in which the envelope front or cover panel permits viewing of all of the information on the insert sheets and is moisture resistant to protect the insert sheets during shipping.

SUMMARY OF THE INVENTION

Accordingly, it is an object of this invention to provide an improved form assembly.

It is another object of this invention to provide an improved combination form/envelope assembly.

It is an additional object of this invention to provide an improved shipping form assembly.

It is a further object of this invention to provide an improved multiple copy shipping form assembly which requires minimum handling and preparation in its use.

In accordance with a preferred embodiment of this invention, an envelope and form assembly includes an envelope having an opaque back and a transparent cover, with the envelope closed on three sides. A master record ply is attached to the closed end of the envelope and overlies the transparent cover. Insert sheets and carbon transfer sheets are attached to a tear strip located at the open end of the envelope; and in addition, the insert sheets are attached to the closed end of the envelope along lines of perforation. Upon removal of the tear strip, the carbon transfer sheets are removed from the envelope and one or more of the insert sheets are broken along the lines of perforation and removed from the envelope, while other insert sheets remain in the envelope, attached to it at its closed end by the lines of perforation. The master record sheet overlying the envelope is attached to the closed end of the envelope at a perforation line and may be detached from the envelope following the entry of data on it. The clear or transparent cover of the envelope permits observation of the data transferred to an insert sheet by one of the carbon transfer sheets after the carbon transfer sheets have been removed from the envelope. The envelope then may be attached to a package as a shipping order with the insert sheets protected by the envelope and clearly visible through the cover.

BRIEF DESCRIPTION OF THE DRAWINGS

FIGS. 9, 10 and 11 are perspective views of the envelope assembly of FIG. 1, illustrating steps in the use of the assembly;

FIG. 12 is a detailed view of a portion of the back side of the assembly shown in FIG. 1; and FIG. 13 shows the envelope/form assembly of FIG. 1 used as a shipping form affixed to a package.

DETAILED DESCRIPTION

Figure 1:
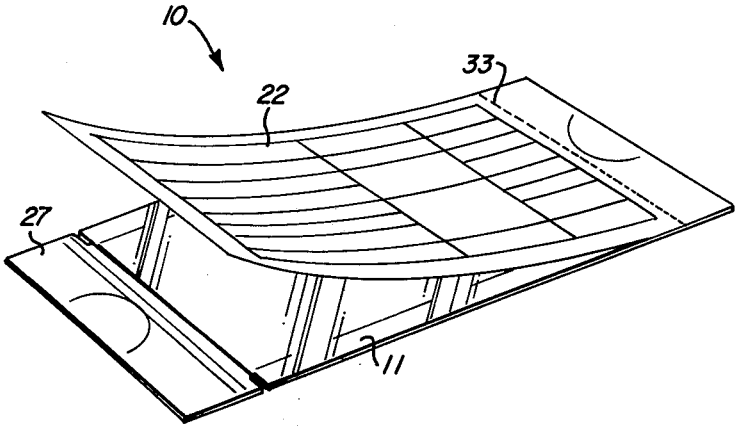
FIG. 1 is a perspective view of an envelope/form assembly constructed in accordance with a preferred embodiment of the invention.
Figure 2:
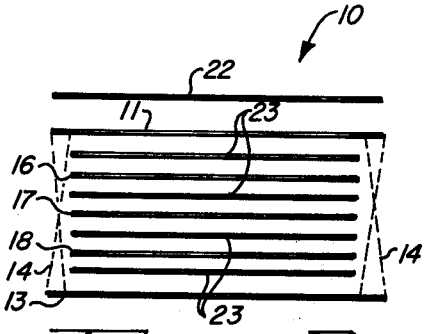
FIG. 2 is a sectional end view of the envelope of FIG. 1.
Figure 3:
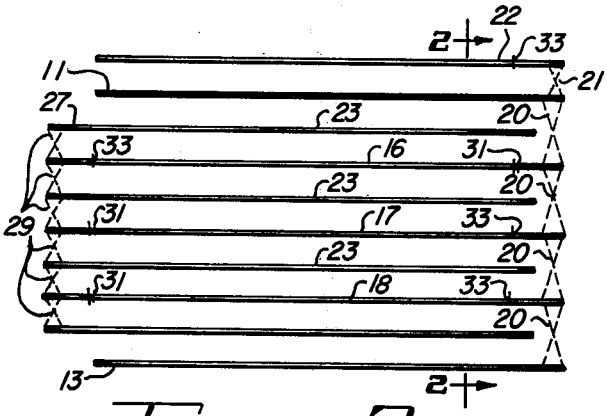
FIGS. 3, 4 and 5 are side sectional views of one form of the envelope assembly of FIG. 1, showing the sequential removal of different portions of the assembly.

Referring now to the drawings, the same reference numbers are used throughout the different figures to designate the same or similar components. In FIG. 1 there is shown an assembly 10 which is a combination form and envelope assembly which is particularly adapted for use as a shipping form or for any application which requires traveling documents where some documents are removed from the assembly at the point of origination. The form/envelope assembly shown in FIGS. 1 and 2 includes an envelope portion having a clear transparent cellophane or glassine top cover sheet 11 and an opaque back or base 13 which is attached to the cover 11 along both sides by means of adhesive strips 14 (FIG. 2). One end of the envelope is sealed or interconnected through insert sheets 16, 17 and 18 by means of adhesive strips 20 (most clearly illustrated in FIG. 3). In addition, a data entry sheet or master sheet 22 is connected to the sealed end of the envelope by an adhesive strip 21, as shown in FIG. 3.

The envelope assembly includes carbon transfer sheets 23 overlying each of the insert sheets 16, 17 and 18 and the back of the envelope 13. As shown most clearly in FIG. 2, none of the carbon transfer sheets 23 or the insert sheets 16 through 18 are connected to the cover 11 and the back 13 of the envelope along the sides. To secure the assembly together, the transfer sheets 23 and the insert sheets 16, 17 and 18 are interconnected at the open end of the envelope to a tear strip 27 by means of adhesive strips 29.

To facilitate use of the form/envelope assembly 10 as a shipping document, each of the insert sheets 16, 17 and 18 is attached at its righthand end (as viewed in FIG. 3) along lines of weakening, typically in the form of perforations. Similarly, these same insert sheets are attached to the tear strip 27 along lines of weakening or perforation; so that they may be removed from the tear strip 27 when desired. The entire assembly, as shown in FIG. 1, then has all of the insert sheets in registry with the data entry master sheet 22 on the top of the envelope. Typically, all of the transfer sheets 16, 17 and 18 and the inside of the envelope back 13 are imprinted with at least some common areas in registration with one another; so that information entered by hand or typewriter on the data entry master sheet 22 is transferred by the carbon transfer sheets 23 to the corresponding ones of the insert sheets 16, 17, 18 and the inside of the envelope back 13.

Figure 4:
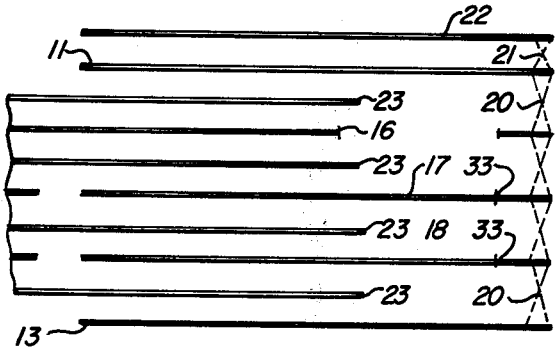

After the necessary data has been entered onto the sheet 22, the form is grasped between the thumb and forefingers of the right and left hands at the closed righthand end of the envelope for the right hand and on the tear strip 27 for the left hand and popped apart. The lines of perforation interconnecting the insert sheets 16, 17 and 18 are of two types, namely "slitter" perforations and "regular" perforations. The "slitter" perforations 31 are indicated in FIG. 3 by double lines whereas the "regular" perforations 33 are indicated by single lines. The slitter perforations 31 are weak or easily broken relative to the regular perforations 33. This means that the regular perforations require more force to break them than the slitter perforations. Consequently when the form 3 is popped apart as described above, the portions separate at the slitter perforations 31 as indicated in FIG. 4. Thus, all of the carbon transfer sheets 23 move to the left with the tear strip 27, as does the insert sheet 16, which was connected to the righthand or sealed end of the envelope through a slitter perforation 31. The insert sheets 17 and 18, however, remain inside the envelope since they had slitter perforations 31 at the lefthand end interconnecting them with the tear strip 27.

This separation is shown most clearly in FIG. 4. The two portions, namely the tear strip 27 and the remaining envelope portion, are completely separated from one another. The insert sheet 16 may be removed from the tear strip 27 by breaking it loose along the regular perforation line 33 interconnecting it with the tear strip 27. The data entry sheet 22 then may be removed from the top of the assembly by lifting it up as shown in FIG. 1 and breaking it along lines of weakening or perforations 33, which are illustrated as regular perforations but which could be of either the regular or slitter type, since the sheet 22 is independenty handled. Alternatively, the sheet 22 could be attached to the tear strip 27 in a manner similar to the manner of attachment of the insert sheet 16; so that the sheet 22 would be removed from the envelope assembly at the time the tear strip 27 is pulled to the left as shown in FIGS. 3 and 4.

Once the sheet 22 has been removed from the assembly, and following the operation above described, the data entered through the carbon transfer sheet onto the insert sheet 17 is fully readable through the transparent cover 11 of the envelope. The envelope assembly with the sheets 17 and 18 in it then may be attached to a package or other article, if the assembly is to be used as a shipping document, and shipped to its ultimate destination as indicated on the insert sheet 17. Upon arrival ,or at some intermediate point, the insert sheets 17 and 18 may be grasped by reaching into the open end of the envelope; and removal of these sheets then may be effected by popping them apart with sufficient force to break the regular perforations 33 by which these sheets were attached to the sealed end of the envelope. Even after the insert sheets 17 and 18 have been removed, however, the information transferred onto the inside of the envelope back 13 by the bottom carbon transfer sheet 23 serves to identify the necessary shipping information for the recipient of the package.

The particular number of insert sheets and consequently the number of carbon transfer sheets 23 may be varied to suit the particular requirements of the shipping document. The document which has been described above in conjunction with FIGS. 3, 4 and 5 is one which typically is used for sending a package collect to the recipient. In such use, the original data entry sheet 22 is given to the shipper as a receipt. Insert sheet 16, which is removed at the time the envelope is affixed to the package, is kept by the carrier as an accounting copy. Sheet 17 then may be used to constitute a delivery receipt, while insert sheet 18 comprises a consignee's receipt. The information transferred to the inside of the envelope back 13 then constitutes the shipping label for the package to which the assembly is affixed.

Figure 6:
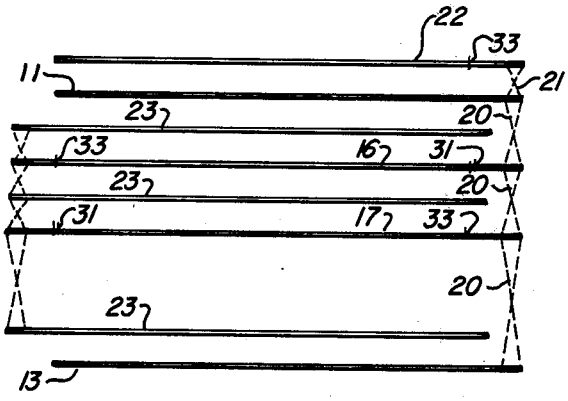
FIGS. 6, 7 and 8 are side sectional views of another form of the envelope assembly of FIG. 1, showing the sequential removal of various parts of the assembly.
Figure 7:
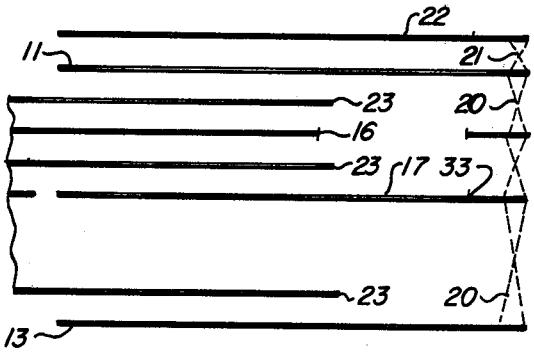
Figure 5:
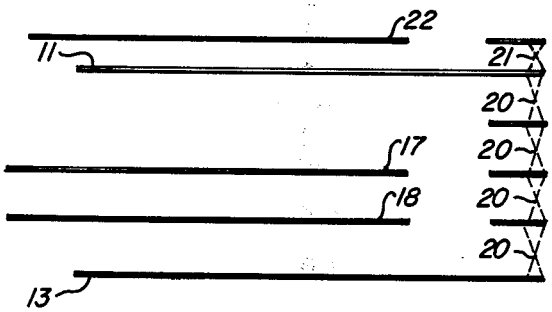
Figure 8:
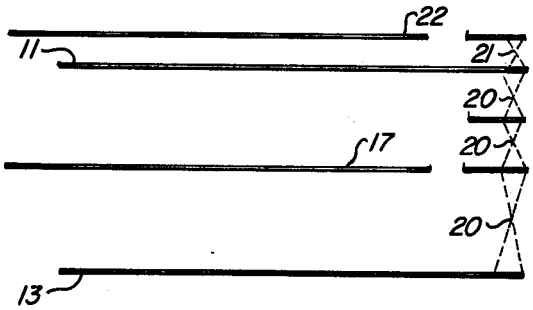

FIGS. 6, 7 and 8 show an alternative arrangement to the structure illustrated in FIGS. 3, 4 and 5. In the assembly variation shown in FIGS. 6, 7 and 8, an arrangement of the type typically used for prepaid shipping documents is shown. This arrangement is the same in all respects as the one described in conjunction with FIGS. 3, 4 and 5 except that the consignee's insert sheet 18 has been eliminated, along with the overlying carbon insert sheet 23 which was used for that insert sheet in the arrangement shown in FIG. 3. When the assembly is used as a prepaid shipping form requiring traveling documents, the data entry sheet 22 again constitutes the shipper's receipt. Insert sheet 16 comprises an accounting copy, while the insert sheet 17, which remains within the envelope after removal of the tear strip 27, comprises a delivery receipt. As in the case of the structure shown in FIGS. 3, 4 and 5, the inside of the envelope back 13 constitutes a label for the package to which the envelope is affixed for shipping.

Referring now to FIGS. 9, 10 and 11, the manner of using either of the versions shown in FIGS. 3 through 5 or in FIGS. 6 through 8 is shown. FIG. 9 illustrates the manner in which the form assembly is gripped to sever the various components, as described above, after the data has been entered onto the data entry sheet 22. The tear strip 27 is moved to the left relative to the right-hand edge of the assembly by grasping the envelope/-form assembly as shown in FIG. 9 and popping it apart as indicated in FIG. 10. After the two portions of the assembly have been separated as shown in FIG. 10, the data entry sheet 22 is removed from its position overlying the envelope cover 11 to expose the information transferred to the insert sheet 17 through the transparent cover 11.

When the assembly is used as a shipping form, the back 13 of the envelope preferably is coated with a self-sticking adhesive 40, as shown in FIG. 12, which is covered with a peel-off backing strip 41. Such combinations of adhesive 40 and backing strips 41 are used in a wide number of applications and are ideally suited for the application of the assembly described above in its use as a self-sticking envelope for attachment to packages and the like for shipping. Afterthe data has been entered onto the sheet 22 and the form has been separated into its various components as shown in FIGS. 9, 10, and 11, the backing 41 is removed from the adhesive on the envelope back 13. The envelope assembly, with the insert sheet 17 or sheets 17 and 18 in it, then is affixed to the outside of a package to be shipped, such as the package 45 shown in FIG. 13.

The envelope assembly 10 is illustrated as it typically is used to provide the traveling documents for such a package. By making the envelope cover 11 entirely of transparent material, the entire face of the insert sheet 17 or the inside of the envelope base 13, after removal of the insert sheet 17 (or sheets 17 and 18), is readily observable through the cover 11. At all times the shipping information is clearly readable. In addition, the cover 11, made of cellophane or glassine, serves as a water and dirt impervious protective covering for the shipping documents located inside it. By removing all of the carbon transfer sheets prior to shipping, accidental smudging or obliteration of the information on the traveling documents is prevented. The self-sticking adhesive applied to the back of the envelope is a convenient manner with which to attach the envelope to a package 45. Of course, other types of adhesive or other means of attachment could be used if desired, but this type of adhesive has been found to be most convenient.

If the entry of some materials on various ones of the insert sheets or on the back of the envelope is not desired or required, spot coated carbon transfer sheets may be used or printed blockouts on the different insert sheets may be utilized as needed to meet various requirements or objectives of the form for the particular application with which it is used.

In addition, although the foregoing preferred embodiments have been described in conjunction with an individual form for handwritten or typewritten data entry, the inventive concept could be expanded to include continuous series form/envelope construction for processing by computer or the like. The individual envelope/form assemblies however, upon separation from one another for separate subsequent processing, otherwise would be the same as the individual structures which have been described above. The envelope/-form construction is particularly suited to any application which requires traveling documents, a shipping label, and the option of total or sequential removal of internal parts.

We claim:

1. An envelope and form assembly including in combination:

an envelope having a back portion and a cover portion closed on one end and both sides, at least part of the cover portion of said envelope being formed of transparent material;

first and second insert sheets attached to the closed end of said envelope at a first line of weakening;

a plurality of transfer sheets within said envelope, one transfer sheet overlying each of said insert sheets and another transfer sheet overlying the inside of the back portion of said envelope;

a tear strip at the open end of said envelope attached to said transfer sheets and attached to said first and second insert sheets at a second line of weakening, said second line of weakening being stronger than said first line of weakening on said first insert sheet, so that upon removal of said tear strip, said transfer sheets and said first insert sheet are extracted from said envelope, the first line of weakening on the second insert sheet presenting a stronger attachment than the second line of weakening thereon so that upon removal of said tear strip, said second insert sheet remains in said envelope; and data entry sheet overlying at least the part of the cover portion of said envelope formed of transparent material and having a portion attached to one of said closed and of said envelope and said tear strip at a third line of weakening to permit detachment of said entry sheet after the impression of data thereon to transfer such data to said insert sheet and the inside of the back portion of said envelope by said transfer sheets.

2. The combination according to claim 1 wherein said cover portion of said envelope is formed of transparent material of at least the portion overlying said insert sheets between the first and second lines of weakening on said insert sheets.

3. The combination according to claim 1 wherein said data entry sheet is attached to the closed end of said envelope at said third line of weakening.

4. The combination according to claim 1 wherein the outside of the back portion of said envelope has adhesive material thereon to permit attachment of said envelope to an article.

5. The combination according to claim 4 wherein said adhesive is in the form of a self-sticking adhesive with a peel-off backing.

* * * * *